US006725464B2

(12) United States Patent
Humphrey

(10) Patent No.: US 6,725,464 B2
(45) Date of Patent: Apr. 27, 2004

(54) ROTARY JOINT FOR DIVING SUITS

(75) Inventor: Kenneth Michael Humphrey, North Vancouver (CA)

(73) Assignee: Oceanworks International, Inc., Houston, TX (US)

( * ) Notice: Subject to any disclaimer, the term of this patent is extended or adjusted under 35 U.S.C. 154(b) by 33 days.

(21) Appl. No.: 10/147,339

(22) Filed: May 15, 2002

(65) Prior Publication Data

US 2003/0213041 A1 Nov. 20, 2003

(51) Int. Cl.[7] ..... B63C 11/04

(52) U.S. Cl. ..... 2/2.15; 277/929; 277/390; 285/276

(58) Field of Search ..... 2/2.12, 2.13, 2.11, 2/2.17, 2.15, 2.14, 456, 82, DIG. 3; 403/31, 34, 37, 38, 39; 285/95, 98, 374, 276; 277/929, 348, 370, 390, 408

(56) References Cited

U.S. PATENT DOCUMENTS

| | | | | | |
|---|---|---|---|---|---|
| 3,218,110 | A | * | 11/1965 | Conner | 384/481 |
| 3,405,406 | A | * | 10/1968 | Vykukal | 2/2.12 |
| 3,578,361 | A | * | 5/1971 | Corrigan | 285/98 |
| 3,947,044 | A | * | 3/1976 | Friedrich | 277/411 |
| 3,951,419 | A | * | 4/1976 | Abrahams et al. | 277/500 |
| 4,431,217 | A | * | 2/1984 | Witt | 285/276 |
| 4,541,638 | A | * | 9/1985 | Ogawa et al. | 277/402 |
| 4,549,753 | A | | 10/1985 | Nuytten | |
| 4,594,734 | A | | 6/1986 | Vykukal | |
| 4,596,054 | A | * | 6/1986 | MacKendrick et al. | 2/2.12 |
| 4,598,427 | A | | 7/1986 | Vykukal | |
| 4,647,076 | A | | 3/1987 | Pollack et al. | |
| 4,752,089 | A | | 6/1988 | Carter | |
| 4,903,941 | A | | 2/1990 | Nuytten | |
| 5,599,110 | A | * | 2/1997 | MacKendrick | 384/501 |

FOREIGN PATENT DOCUMENTS

| | | | |
|---|---|---|---|
| CA | 1103179 | | 6/1981 |
| CA | 1296032 | | 12/2002 |
| EP | 0981000 | A1 | 2/2000 |
| GB | 1038964 | * | 8/1966 |
| GB | 1603199 | | 4/1977 |
| GB | 1604235 | | 5/1977 |

OTHER PUBLICATIONS

Article entitled "Metal Armour for Deep Sea Diving". Deep Sea Diving and Submarine Operations. Davis, Sir Robert H., pp. 213–213A, Sixth Edition.

* cited by examiner

*Primary Examiner*—Rodney M. Lindsey
(74) *Attorney, Agent, or Firm*—John Russell Uren

(57) ABSTRACT

A rotary joint used for armored diving suits which joint allows rotary motion and which seals the internal portions of the diving suit from the high pressure water in which the user is operating. The rotary joint allows axial movement during operation and reduces premature seal failure due to moments created about the axis of the joint which are prevented from reaching the seals allowing rotating movement. In the event of seal failure, a fail-safe sealing system comprising back up seals not used during normal suit operation is used to isolate the internal portions of the diving suit from water ingress.

18 Claims, 4 Drawing Sheets

ROTARY JOINT FOR DIVING SUITS

INTRODUCTION

This invention relates to a rotary joint used for sealing and joint rotation and, more particularly to a rotary joint used in armored diving suits and which joint includes fail-safe sealing.

BACKGROUND OF THE INVENTION

Joints used in armored diving suits are, of course, well known in the industry. Such joints have typically used a fluid within the joint which fluid is held in a cavity defined by seals and such a joint is illustrated and described in U.S. Pat. No. 1,414,174 (Compos). Compos teaches that portions of the rotary joint contact the fluid and the fluid prevents the joint from collapsing under the high operating pressures under which such diving suits are typically used. The fluid, being practically incompressible, acts to support the joint members with which it is in contact and further acts as a lubricant to offer a substantially friction free or very low friction support surface for rotary motion of the members of the joint in contact with the fluid.

However, problems are inherent with existing apparatuses used for sealing the suit and allowing rotary motion of the joint. One problem is that tilting or misalignment often occurs between joint members about the axis of rotation. Such tilting or asymmetric configuration of the members may result in seals otherwise concentric about the axis of the joint being lifted out of contact with their complementary sealing members on one side of the joint. Such asymmetry of the seals can cause leakage from within the annular cavity of the rotary joint. Such leakage is to be prevented since, of course, the water within which the diver may be operating may enter the internal cavities of the suit. This leads to a situation which is to be avoided.

U.S. Pat. No. 4,459,753 (Nuytten) teaches a rotary joint in which circumferential rings maintain concentricity of the joint about a vertical axis. Nuytten, however, does not prevent tilting or misalignment of the upper ring with respect to the rotating seals and if the aforementioned side loads about the axis of rotation arise, the upper and lower joint elements may tilt. This asymmetry tends to lift or displace one edge of the seal off the mating surface which can cause the aforementioned problem where fluid tends to leak and wherein the joint collapses. This is a further situation to be avoided.

U.S. Pat. No. 4,903,941 (Nuytten) teaches a similar rotary joint where the upper and middle members are aligned by means of balls or a TEFLON (Trademark) strip. In the joints taught by both of these patents, the adjacent joint elements are aligned radially but are free to move axially. However, since two adjacent joint elements must be accurately aligned both axially and radially, Nuytten '032 suffers from the possibility of such misalignment.

SUMMARY OF THE INVENTION

According to one aspect of the invention, there is provided a rotary joint for a diving suit comprising first and second members having a sealing relationship therebetween defining a fluid holding cavity, said rotary joint comprising at least one seal between said first and second members extending about an axis and a tilt prevention member operably located between said first and second members to allow relative rotation of said first and second members and to prevent axial relative movement between said first and second members said at least one seal including a seal mounted for axial movement within one of said first and second members.

According to yet a further aspect of the invention, there is provided a fail-safe sealing arrangement for a diving suit having an internal opening for a user, said fail-safe sealing arrangement comprising first, second and third members defining a first sealed fluid carrying cavity sealed by a first set of seals and a second sealed fluid carrying barrier sealed by a second set of seals, said second set of seals being operable only upon sealing failure of said first set of seals.

According to still yet a further aspect of the invention, there is provided a fail-safe sealing arrangement for a diving suit having an internal opening for a user, said fail-safe sealing arrangement comprising first, second, third and fourth members defining a first sealed fluid carrying cavity sealed by a first set of seals and a second sealed fluid barrier sealed by a second set of seals, said third and fourth members being axially movable relative to said first and second members and said second set of seals being operable only upon failure of said first set of seals and when said first and third members are in contacting relationship preventing further relative axial movement therebetween.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figures 1A, 1B:
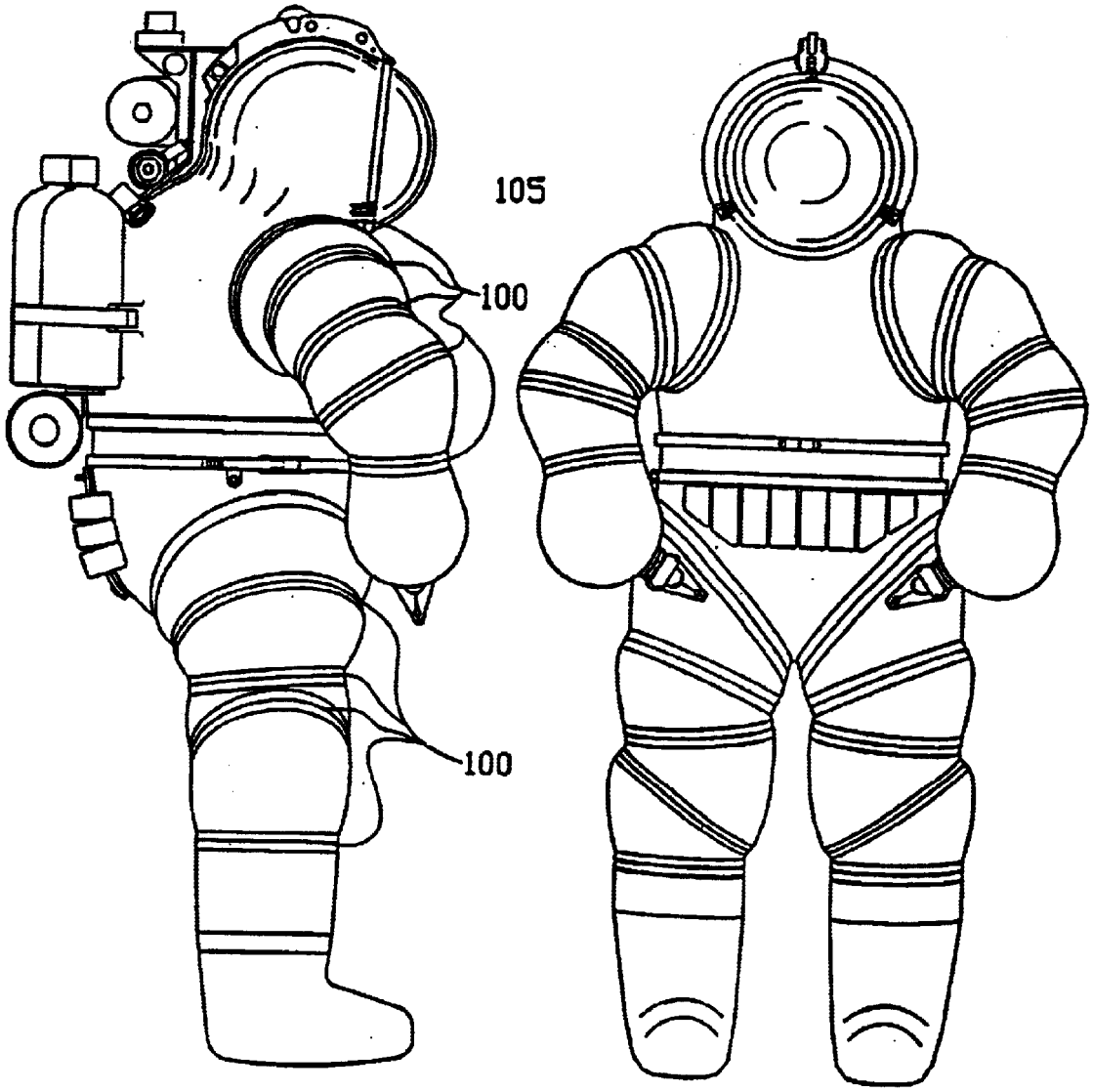
FIGS. 1A and 1B are diagrammatic side and front views illustrating an armored diving suit utilizing the rotary joint according to the invention.

Referring now to the drawings, an armored diving suit according to the invention is generally illustrated at 105 (FIG. 1) which diving suit 105 is used for particularly high external pressures and a substantially lower pressure internally and which diving suit 105 incorporates a plurality of rotary joints generally illustrated at 100 which joints 100 are used in the various limbs of the diving suit 105.

Figure 2:
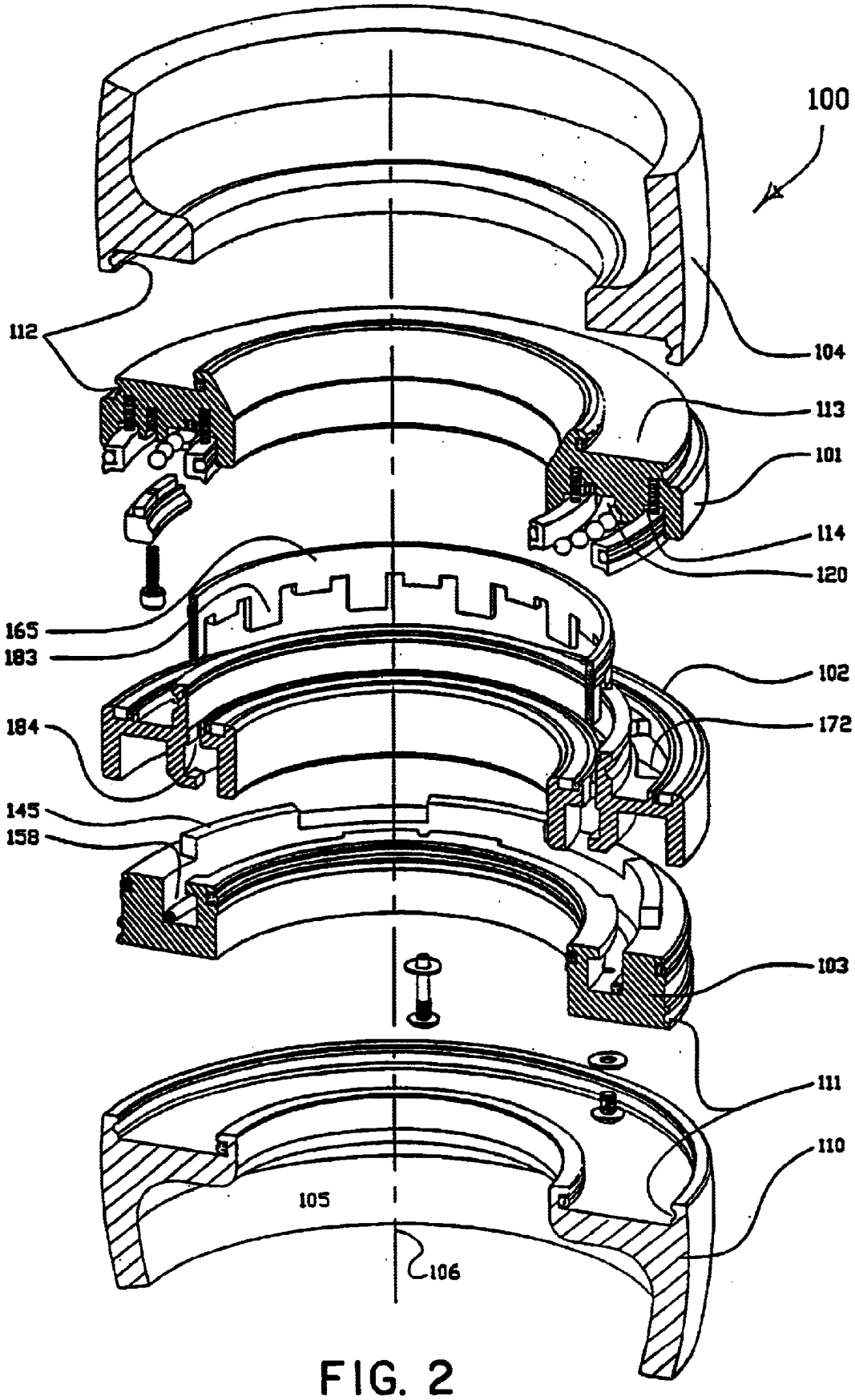
FIG. 2 is a diagrammatic isometric and exploded view of the rotary joint according to the invention.

Rotary joint 100, shown in exploded view in FIG. 2, comprises three principal annular members, namely upper member 101, middle member 102 and lower member 103. These three members 101, 102, 103 generally form the rotary joint 100 which is used within the armored atmospheric diving suit 105 to allow flexion, extension or rotary motion to the exoskeletal armored diving suit 105. It will be understood that the diving suit itself is not shown or described in detail as the present invention is directed towards the rotary joint 100 itself.

Upper member 101 and lower member 103 are designed to be connected to portions of the diving suit 105, namely upper connecting diving suit member 104 and lower connecting diving suit member 110. These connections take place using usual attachment techniques such as snap rings in groove 111 and seals which allow connection to the diving suit members 104, 110 and form no part of the present invention.

Figure 3:
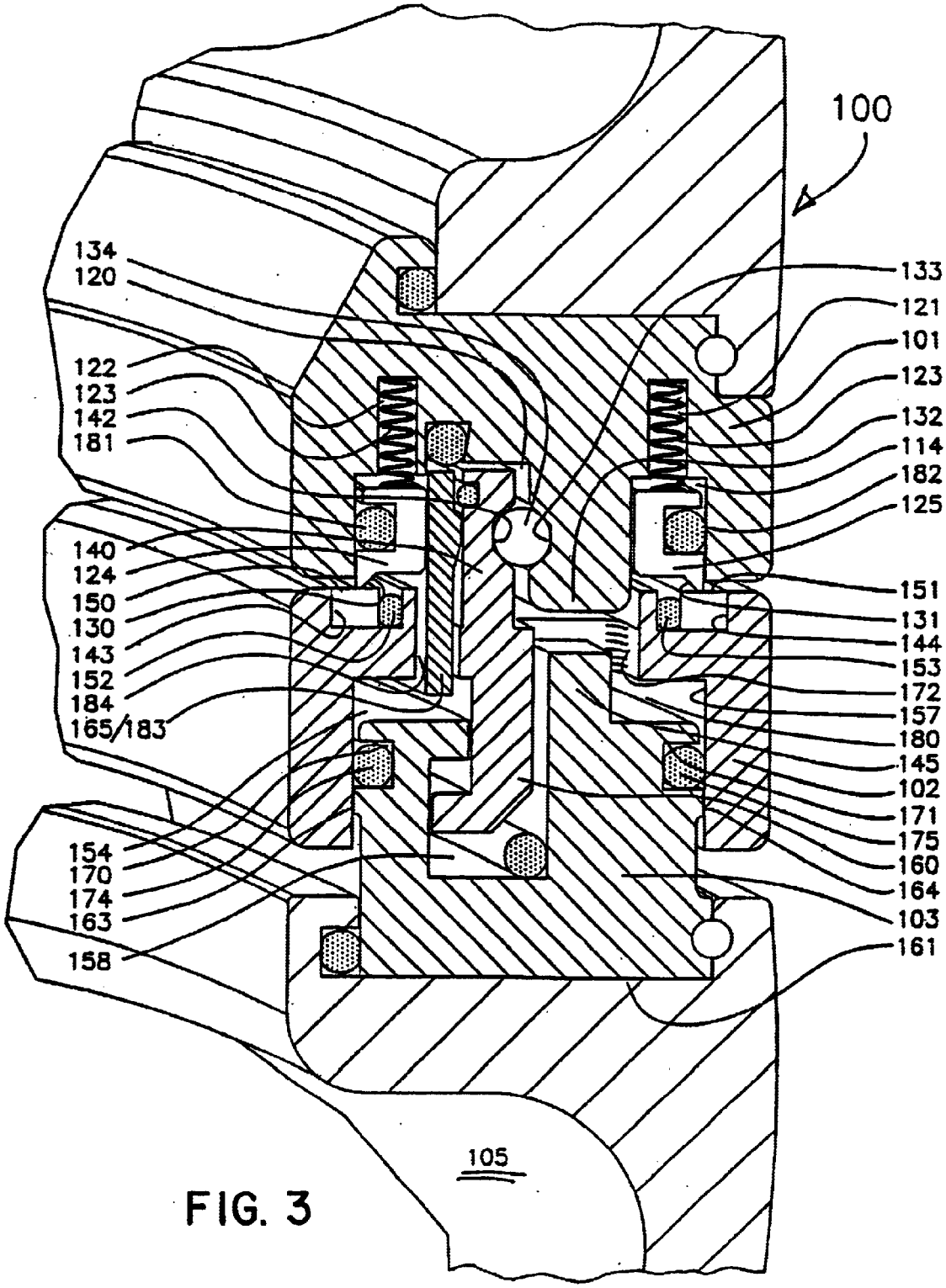
FIG. 3 is a diagrammatic sectional view taken generally along the right side of FIG. 2 illustrating the condition of the rotary joint in its normal and usual operating condition.

Upper member 101 comprises an upper generally flat surface 113 and a lower surface which includes two (2) concentric annular grooves, namely inner annular groove 120 and outer annular groove 114 (see also FIG. 3). A plurality of holes 121, 122 are drilled in two concentric circles, namely an inner and outer circle, respectively. Compression springs 123 are mounted in each of the drilled holes 121, 122 and act on inner and outer concentric sealing rings 124, 125 which are mounted in the inner and outer concentric annular grooves 120, 114, respectively.

Each of the concentric sealing rings 124, 125 have lower faces which are reduced in area by means of step cuts 130, 131 in the lower inside edge of the outer sealing ring 125 and the lower outside edge of the inner sealing ring 124. The reduction in surface area caused by the step cuts 130, 131, results in increased surface loading by each of the sealing rings 124, 125 and reduces the frictional area of the sealing rings 124, 125 acting on sealing surfaces 150, 151, respectively, as will be described.

Upper member 101 includes an annular extension 132 which extends downwardly and which acts to contact a complementary protuberance 145 on lower member 103 during seal failure as will be explained. A three sided groove 133 is machined in the inner surface of annular extension 132 and extends circumferentially around the inner surface of annular extension 132. A plurality of precision machined balls 134 are mounted in three sided groove 133 and extend about the inner circumference of the annular extension 132. Balls 134 are of a size that all three surfaces of the groove 133 are contacted by the balls 134 when properly placed. A complementary groove 142 is machined in middle member 102 as will also be explained.

Middle member 102 likewise has an annular member 140 which extends upwardly into the inner annular groove 120 and which is fractionally smaller in diameter on its outside surface than the inside diameter for the annular extension 132 in the upper member 101. Annular member 140 likewise has a three sided groove 142 which matches the three sided groove 133 in annular extension 132 and likewise accommodates the balls 134 on all three surfaces. The precision balls or bearings 134 are positioned between annular member 140 and annular extension 132 by way of a ball entry gate (not shown) usual in such applications. Thus, a precision bearing surface is formed comprising the two three-sided grooves 133, 142 and balls 134 between annular member 140 and annular extension 132 which bearing surface and balls 134 allow relative rotation between the upper and middle members 101, 102 but which will not allow relative axial angular movement of the upper and middle members 101, 102.

Two annular grooves 143, 144 are machined in the upper surface of the middle member 102. Each groove 143, 144 carries a low friction ring 150, 151 made from TEFLON (Trademark) or similar low friction substance and which rings are fitted into annular grooves 143, 144 and which are sealed by means of elastomer seal rings 152, 153, respectively, likewise mounted within annular grooves 143, 144. The narrow edge created by the step cuts 130, 131 of the concentric sealing rings 124, 125 bear on the low friction rings 150, 151 and form an inner and outer seal, respectively, while allowing rotation of the upper member 101 relative to the middle member 102. Seal rings 124, 125 conveniently have a highly polished surface to further reduce any frictional torque acting to inhibit rotational movement of the upper member 101 relative to the middle member 102. Seal rings 124, 125 are allowed axial movement which axial movement is biased downwardly against seal rings 150, 151 by compression springs 123.

A narrow annular area between the seal ring 124 and the inner cylindrical surface of annular groove 120 sealed by elastomer seal 181 and seal ring 125 and the outer cylindrical surface of annular groove 114 sealed by the elastomer seal 182 allows the aforementioned axial movement of the seal rings 124, 125 and also allows the pressure of the supporting fluid in the joint cavity 180, which is greater than and proportional to the surrounding water pressure to assist the seal rings 124, 125 to maintain satisfactory seal loading against the sealing surfaces on the upper side of the seals rings 150, 151 with the assistance of compression springs 123 acting downwardly on seals 124, 125.

The middle member 102 has two annular grooves 154, 157 cut into its lower face forming two annular cylinders, and a downwardly extending concentric annular projection 160 is likewise defined by the outside surface of the annular groove 154 and the inside surface of the annular groove 157 as will be explained.

The inner diameter of the groove 154 is preferably the same nominal diameter as the inner cylindrical surface of groove 120 in upper member 101. Similarly, the outer diameter of groove 157 shall be the same nominal diameter as the outer cylindrical surface of groove 114 in upper member 101 such that the pressure generated in the fluid in the joint cavity 180 by the annular piston defined by seals 174, 175 in the lower member 103 is substantially the same as the pressure generated by the annular area defined by the two seals 181,182 in the sealing rings 124,125, respectively, in the upper member 101 thereby eliminating any significant axial loading on the bearing balls 134, except as provided by the springs 123.

Lower member 103 has a face 161 which attaches to adjacent portions of the diving suit 105 and the inside and outside surfaces 163, 164 are sized to allow a loose sliding fit of the lower member 103 into the annular grooves 154, 157 of the middle member 102. Grooves 170, 171 are machined into the inside and outside surfaces of the lower member 103 and carry elastomer seals 174, 175, respectively, which form sealing surfaces against the inner and outside faces of the annular grooves 154, 157 machined in middle member 102. An annular groove 158 is provided in lower member 103 to accommodate the annular projection 160 of the middle member 102 and the elastomer seal 193 therein.

Middle member 102 has a plurality of slots 172 (FIGS. 2 and 3) which pass axially through the middle member 102. Slots 172 allow fluid communication from the sealed cavity below the middle member 102 to the sealed cavity above the middle member 102 thereby forming a single fluid carrying cavity 180.

A first fluid holding cavity is defined in upper and middle members 101, 102 by elastomeric rings or seals 181, 182, the rotating seal formed by the two seal rings 124, 125 and the low friction sealing rings 150, 151, and elastomer seals 152, 153 and the elastomeric seals 174, 175 in lower member 103. Thus, axial loading on the rotary joint 100 between the lower and upper members 101, 103 is carried by the fluid in the aforementioned cavity 180 just described, the fluid providing a substantially friction free bearing with rotation between the upper member 101 and middle member 102 being allowed between sealing rings 124, 125 and sealing surfaces 150, 151.

In addition, lower member 103 is free to move angularly to a limited degree within the annular cylinders 154, 157 within the underside of middle member 102. This small angular movement of lower member 103 will be dependent upon the volume of fluid within the joint cavity 180 and, when supplemented by the angular movement allowed in similar joints throughout a limb of the diving suit 105, provides for enhanced angular motion in the limb. Such increased limb movement due to the limited angular movement of a plurality of lower members 103 in a number of joints 100 in a typical limb is described in greater detail in U.S. Pat. No. 4,153,781 (Humphrey), the contents of which are incorporated herein by reference.

Figure 4:
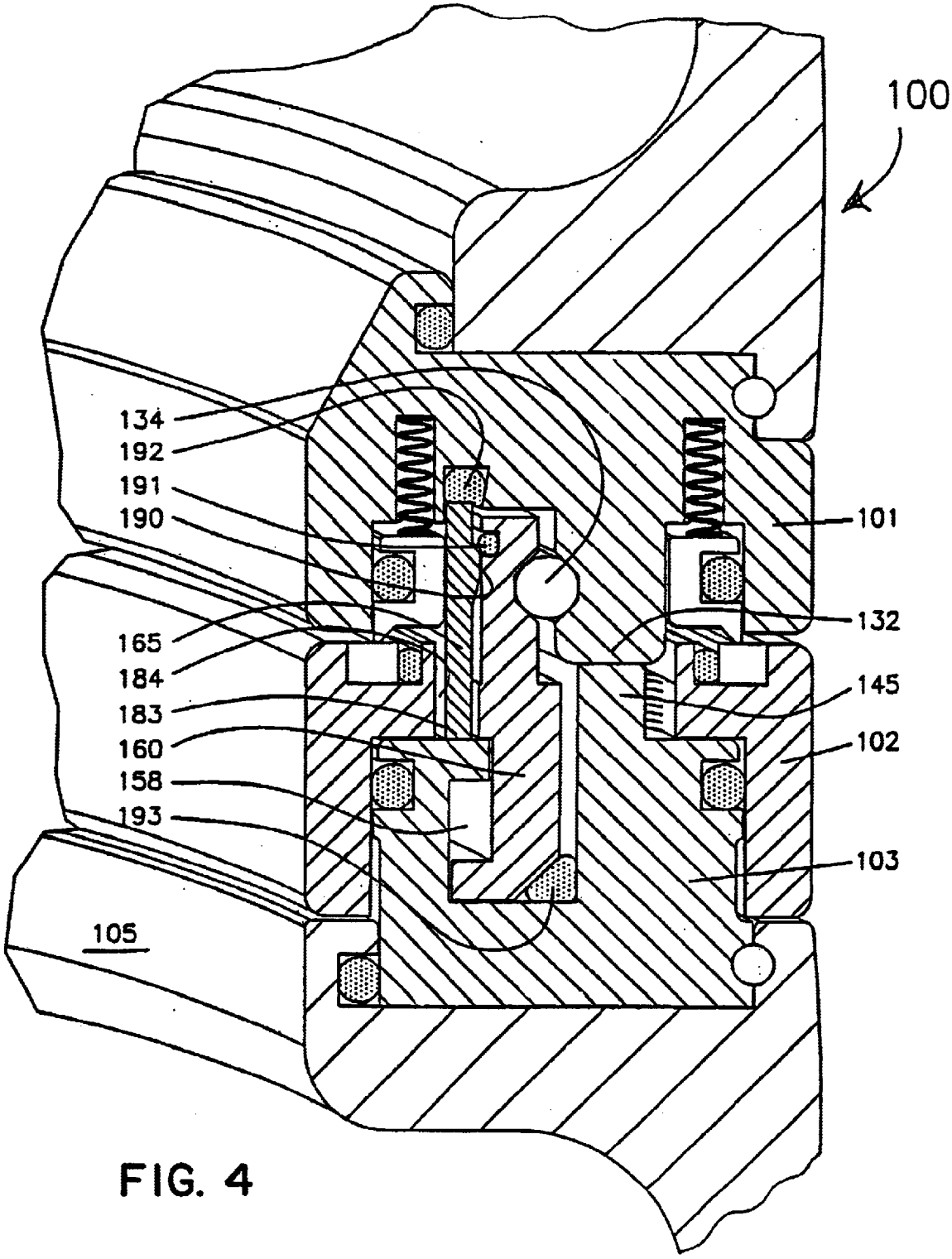
FIG. 4 is a diagrammatic sectional view of the rotary joint similar to FIG. 2 but in its collapsed condition particularly illustrating the fail-safe sealing arrangement according to the invention.

A floating ring 165 (FIG. 2) extends about the axis 106 of the joint 100 with extensions 183 which extend downwardly within annular slots 184 (see also FIGS. 3 and 4). Seals 191, 192, 193 are all provided as shown in upper, middle and lower members 101, 102, 103 and act in association with floating ring 165 and downwardly extending projection 160 to seal the internal cavity of diving suit 105 as will be explained.

Operation

In operation, the rotary joint 100 will be assembled in accordance with the description of the various components including the addition of the balls 134 and the joint fluid.

In ordinary operation as viewed in FIG. 3, the lower member 103 will move axially in response to external water pressure within the annular cylinders 154, 157 which define the lower portion of the annular cavity 180 thereby pressurizing the fluid in the annular cavity 180 which provides a fluid bearing between upper member 101 and lower member 103. Lower member 103 will be acting on the fluid held in the fluid cavity 180 defined by the seals 174, 175 in lower member 103, seals 181, 182 acting on upper member 101 and the seal provided by step cuts 130, 131 in concentric sealing rings 124, 125 acting on low friction rings 150, 151 and seals 152, 153 in middle member 102. A degree of universal angular movement of the joint 100 is provided by a limited axial rotation of lower member 103 relative to the middle member 102. Rotation of the joint 100 is permitted between upper member 101 and middle member 102 but no axial or angular movement between middle member 102 and upper member 101 is permitted because of balls 134 acting between upper member 101 and middle member 102. Accordingly, rings 124, 125 are maintained in substantially constant pressure with sealing surfaces 150, 151 thereby contributing to enhanced seal reliability.

In the event of failure of any of the seals defining the annular fluid holding cavity 180, the fluid within the joint 100 will flow outwardly from the cavity 180 in joint 100 at the point of failure since the fluid held in the annular fluid holding cavity 180 is under considerable pressure due to axial loading on the joint members 101, 103 due to exterior water pressure. As the fluid leaves the fluid holding cavity 180, lower member 103 will be acting on less fluid in the cavity 180 and, therefore, it will move upwardly within annular cylinders 154, 157 in the middle member 102 until protuberances 145 of lower member 103 contact annular extension 132 of upper member 101. At this point, the upper member 101 and lower member 103 will be in the configuration illustrated in FIG. 4 and will essentially act as a single member because of the substantial axial force between them. No further rotation of the upper member 101 relative to the middle member 102 will take place. Middle member 102 will be retained in place by the balls 134 in the grooves 133, 142 in the upper and middle members 101, 102, respectively.

A fail-safe sealing configuration takes place as the lower member 103 moves towards the upper member 101 in the event of failure of the seals under normal operating conditions. The extensions 183 of floating ring 165 extending through annular slots 184 in middle member 102 will contact lower member 103 and compress seal 192. Protuberance or ridge 190 will contact and compress seal 191 and seal 193 will be compressed by downwardly extending projection 160 of middle member 102 when annular projection 145 contacts extension 132. A new sealed barrier is thereby formed which is defined by seals 191 contacting protuberance 190, and the upper end of annular ring 165 contacting seal 192 and the annular projection 160 compressing seal 193, respectively. This sealed barrier prevents water bypassing the failed seals from entering the internal areas of the diving suit 105. While the joint 100 will not now rotate, the user is protected from the ingress of water due to any leakage caused by the failed seals which creates an enhanced safety for the user.

Many modifications will readily occur to those skilled in the art to which the invention relates and the specific embodiments described should be taken as illustrative of the invention only and not as limiting its scope as defined in accordance with the accompanying claims.

I claim:

1. Rotary joint for a diving suit comprising first and second members having a sealing relationship therebetween defining a fluid holding cavity, said rotary joint comprising at least one seal between said first and second members extending about an axis and a tilt prevention member operably located between said first and second members to allow relative rotation of said first and second members and to prevent axial relative movement between said first and second members said at least one seal including a seal mounted for axial movement within one of said first and second members.

2. Rotary joint as in claim 1 wherein said tilt prevention member comprises a plurality of bearings extending about a circumference between said first and second members.

3. Rotary joint as in claim 2 wherein said bearings are balls.

4. Rotary joint as in claim 3 wherein said sealing relationship between said first and second members is defined by a first set of seals mounted in one of said first and second members and a second set of seals mounted in said other of said first and second members, said first set of seals being in operable contact with said second set of seals, said first and second set of seals allowing relative rotary movement between said first and second members.

5. Rotary joint as in claim 4 wherein said second set of seals comprises at least one flat surfaced bearing positioned within one of said first and second members and said first set of seals comprises at least one sliding seal in contact with and allowing said relative rotary movement between said first and second members.

6. Rotary joint as in claim 5 wherein said at least one sliding seal has a narrow edge in contact with and slidable on said flat surfaced bearing during said relative rotary movement between said first and second members.

7. Rotary joint as in claim 6 wherein said at least one sliding seal defines said seal mounted for axial movement within said one of said first and second members.

8. Rotary joint as in claim 7 wherein said axial movement is influenced by springs acting on said at least one sliding seal and tending to maintain said sliding seal in contact with said flat surfaced bearing.

9. Rotary joint as in claim 8 wherein said at least one sliding seal numbers two and said at least one flat surface bearing numbers two.

10. Rotary joint for a diving suit as in claim 9 and further comprising a fail safe sealing arrangement in the event of failure and leakage of said first and second set of seals.

11. Rotary joint as in claim 10 wherein said fail safe sealing arrangement comprises a third member axially movable relative to said first and second members and fail safe seals forming said sealing arrangement in the event of failure of said first and second set of seals.

12. Fail-safe sealing arrangement for a diving suit having an internal opening for a user, said fail-safe sealing arrangement comprising first, second, third and fourth members defining a first sealed fluid carrying cavity sealed by a first set of seals and a second sealed fluid barrier sealed by a second set of seals, said third and fourth members being axially movable relative to said first and second members and said second set of seals being operable only upon failure of said first set of seals and when said first and third members are in contacting relationship preventing further relative axial movement therebetween.

13. Fail-safe sealing arrangement for a diving suit having an internal opening for a user, said fail-safe sealing arrangement comprising first, second and third members defining a first sealed fluid carrying cavity sealed by a first set of seals and a second sealed fluid carrying barrier sealed by a second set of seals, said second set of seals being operable only upon sealing failure of said first set of seals.

14. Fail-safe sealing arrangement for a diving suit as in claim 13 wherein said third member moves axially relative to said first and second members and said third member is movable with said second member during relative rotary movement of said first and second members.

15. Fail-safe sealing arrangement as in claim 14 wherein said first set of rotary seals defining said first fluid carrying cavity is defined by a rotary seal allowing rotary movement between said first and second members and a circumferential seal between said second and third members.

16. Fail-safe sealing arrangement as in claim 15 wherein said second set of seals comprises first circumferential seals contacting said second and third members when said first and third members are in contacting relationship prohibiting axial movement therebetween.

17. Fail-safe sealing arrangement as in claim 16 and further comprising a fourth member being relatively moveable between said first and second and third members and said second set of seals further comprising second circumferential seals in contact with said fourth member when said first and third members are in said contacting relationship.

18. Fail-safe sealing arrangement as in claim 17 and further comprising a tilt prevention member operably located between said first and second members to prevent axial relative movement between said first and second members when said first and third members are not in said contacting relationship.

* * * * *